US006079892A

United States Patent [19]

Yamaguchi et al.

[11] Patent Number: 6,079,892

[45] Date of Patent: Jun. 27, 2000

[54] METHOD FOR DETECTING AN END PORTION OF A RECORDING MEDIUM IN A RECORDING APPARATUS AND END PORTION DETECTION APPARATUS

[75] Inventors: Naoto Yamaguchi; Hiroshi Ishida; Masayuki Kumazaki; Kazuhiko Yamaguchi; Yukihiro Uchiyama, all of Suwa, Japan

[73] Assignee: Seiko Epson Corporation, Tokyo, Japan

[21] Appl. No.: 08/712,783

[22] Filed: Sep. 12, 1996

[30] Foreign Application Priority Data

Sep. 13, 1995 [JP] Japan ..... 7-260689

[51] Int. Cl.[7] ..... B41J 29/42

[52] U.S. Cl. ..... 400/708; 400/709; 400/711

[58] Field of Search ..... 226/45; 364/571.01, 364/571.02, 571.04, 571.05; 400/703, 708, 708.1, 709, 711

[56] References Cited

U.S. PATENT DOCUMENTS

| | | | |
|---|---|---|---|
| 4,540,299 | 9/1985 | Yamada . | |
| 4,614,950 | 9/1986 | Ito | 346/76 PH |
| 5,150,977 | 9/1992 | Yoshikawa | 400/703 |

FOREIGN PATENT DOCUMENTS

| | | |
|---|---|---|
| 1 166 758 | 5/1984 | Canada . |
| 0 015 553 A1 | 9/1980 | European Pat. Off. . |
| 0 031 137 A2 | 7/1981 | European Pat. Off. . |
| 0 266 209 A2 | 5/1988 | European Pat. Off. . |
| 0 539 857 A1 | 5/1993 | European Pat. Off. . |
| 52-58614 | 5/1977 | Japan . |
| 61-79686 | 4/1986 | Japan . |
| 62-119087 | 5/1987 | Japan . |
| 1-206077 | 8/1989 | Japan . |
| 3-7371 | 1/1991 | Japan . |
| 2 220 742 | 1/1990 | United Kingdom . |

OTHER PUBLICATIONS

700 IBM Technical Disclosure Bulletin 30 (1987) Sep., No. 4, Armonk, NY, USArr.

*Primary Examiner*—John Hilten
*Attorney, Agent, or Firm*—Stroock & Stroock & Lavan LLP

[57] ABSTRACT

A sheet end detector comprising a light-emitting element and a light-receiving element for detecting changes in the amount of light associated with movement of a piece of a recording medium is provided. A standard value calculator detects the difference between the sheet end detector platen voltage Vp corresponding to light reflected only from said platen and said sheet end detector paper saturation voltage Vm corresponding to light reflected only from the recording medium. The amount necessary to feed the paper for platen voltage Vp to reach paper saturation voltage Vm is a constant value, irrespective of recording medium characteristics, which is when all of the light is reflected by the recording medium and the entire end portion of a piece of a recording medium has reached a predetermined position relative to the position of the sheet end detector. A standard value is calculated by multiplying this difference by a constant coefficient C and then adding back the lesser of Vp or Vm, C being a numerical value greater than 0 and less than 1 and being an indication of the desired position of the leading edge of the recording medium. A comparator compares the standard value and a signal from the sheet end detector and determines when the signal corresponds to the standard value, which is indicative that the presence of a leading edge or trailing edge of the recording medium has reached a predetermined position.

19 Claims, 6 Drawing Sheets

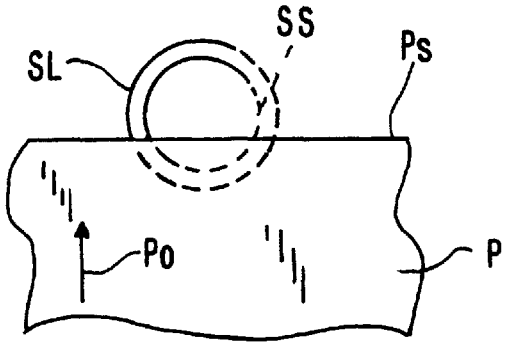
FIG.6
FIG. 7
PRIOR ART
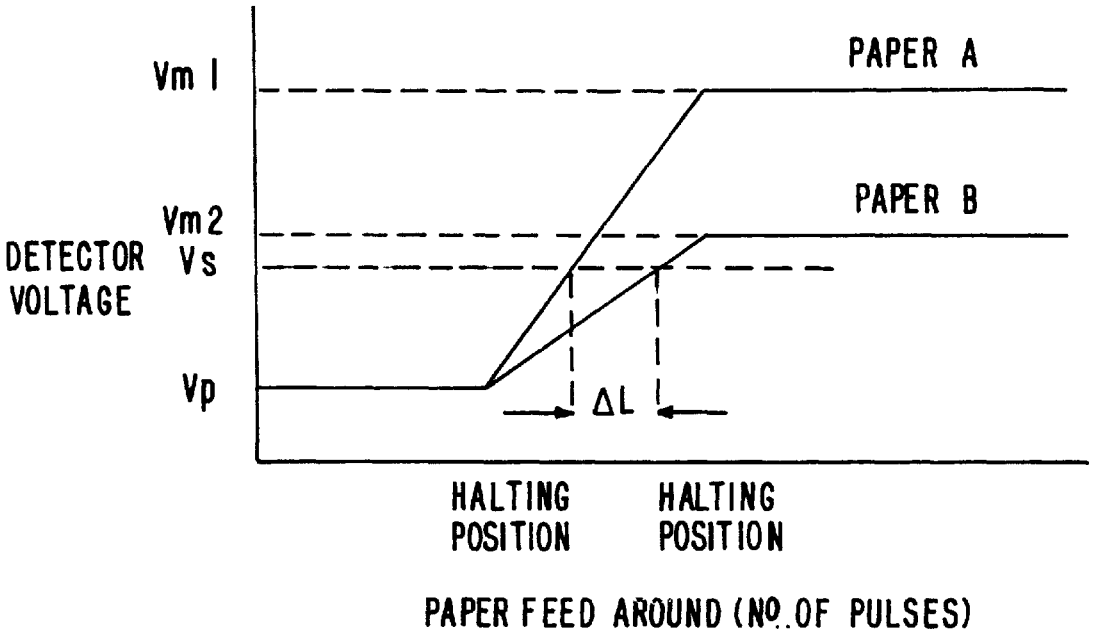

METHOD FOR DETECTING AN END PORTION OF A RECORDING MEDIUM IN A RECORDING APPARATUS AND END PORTION DETECTION APPARATUS

BACKGROUND OF THE INVENTION

1. Field of the Invention

This invention relates to technology for detecting a leading edge and/or a trailing edge of a piece of a recording medium, suitable for use in a recording apparatus such as either a serial recording apparatus wherein a recording head is moved in the direction across the width of a piece of a recording medium and printing is carried out or a page recording apparatus which transfers a toner image formed on a photoconductive drum to a piece of a recording medium.

2. Description of the Related Art

In a conventional recording apparatus, the leading edge of a piece of a recording medium, such as paper, is detected when the piece of recording medium is loaded from a paper supply port. The recording apparatus then sets the position of the recording paper leading edge at a predetermined position with respect to a recording line and carries out what is known as an initial printing position alignment operation. Also, if necessary, the recording apparatus detects a trailing edge of the piece of recording medium and carries out an operation to stop recording thereon.

Detection of the leading and trailing edges of the sheet of recording medium is conventionally carried out by including a switch in the paper feed path which switches on when it contacts the piece of recording medium and switches off when contact with the recording medium is broken. However, this method typically provides low detection accuracy. The low accuracy can be caused by factors such as the choice of a simple mechanical construction and method of signal processing in the recording apparatus.

When the end portion of a piece of a recording medium must be detected with a high level of accuracy, a different conventional method is utilized. A sheet end detector is used, which includes a light-emitting element which irradiates a piece of a recording medium with light and a light-receiving element which receives light reflected from this irradiated piece of recording medium. This light-receiving element is disposed in a position where it is possible to intercept light reflected from the piece of recording medium. The light receiving element generates a signal which changes when light is or is not reflected from the recording medium. The level of the signal indicates the level of light reflected from the recording medium. The signal is received by the sheet end detector and is compared with a previously set predetermined standard level.

It has been determined that such a conventional method has drawbacks. For example, as is shown in FIG. 6, a light beam SL is emitted from a light-emitting element SS of a sheet end detector. As light travels from light-emitting element SS, it will spread slightly. Therefore, when light beam SL reaches recording medium P, its diameter is slightly greater than the diameter of light-emitting element SS. In the same way, when the light beam SL is reflected from recording medium P, and is received by a light-receiving element (not shown), it will be even more diffused and its diameter will be even greater.

When piece of recording medium P moves in a direction towards a printing region, as indicated by arrow PD in FIG. 6, the amount of light reflected by the piece of recording medium changes as a leading edge Ps of medium passes through light beam SL. As this occurs, the signal level, that is, the detector voltage, changes in proportion to the amount of the recording medium which has been fed through beam SL, as shown in FIG. 7. However, the amount of reflected light is also dependent upon the reflectance ratio of the piece of recording medium. Because different media have different reflectance ratios, the rate of change of the detector voltage- that is, the slope of the signal depicted in FIG. 7, is influenced by the recording medium reflectance ratio. For example, a paper A and a paper B will cause the generation of detection voltages having different slopes. Finally, the detector voltage changes up to the saturation voltages Vm1 and Vm2, which are governed by the recording medium reflectance ratio, and afterwards becomes constant.

In operation, when the recording medium is being fed, the detector voltage will reach a predetermined standard level Vs. When voltage Vs is reached, the sheet end detector will determine that the leading edge of the recording medium has passed the position of beam SL. However, it has been determined that because of the different reflectance ratios of recording media paper A and paper B (FIG. 7), the leading edge of a recording medium P is identified at different positions in the printing path because Vs will be reached at an earlier location with paper A than with paper B. This difference in location is identified as error $\Delta L$ where $\Delta L$ is a measure of the difference in location where two different recording media were halted and the apparatus determined that the leading edge of each recording medium had been detected. Also, because of the diffusion of light noted above, the reflected light may reach the detector before the recording medium is in the proper position, thus resulting in a positioning error.

Because there are natural variations in the level of irradiation of the light-emitting element and in the detection sensitivity of the light-receiving element which make up the sheet end detector, in order to reduce the size of this error $\Delta L$ in a conventional apparatus, it would be necessary to carefully select and employ detectors in which the characteristics are the same and the error is reduced. This results in the problem of increased component costs and complexity of the apparatus.

Accordingly, it is desirable to provide a detection method and apparatus which overcome deficiencies in conventional methods and apparatus.

SUMMARY OF THE INVENTION

Generally speaking, in accordance with the invention, a method and apparatus for detecting an end portion of a piece of a recording medium, such as paper, in a recording apparatus is provided, wherein regardless of the reflectance characteristics of the paper, and without the necessity for a high level of consistency in the sensitivity of a light-emitting element or a light-receiving element of a sheet end detector, it is possible to detect an end portion of a piece of a recording medium with a high level of accuracy. In operation, a recording medium is irradiated with light and the position of an end portion of the recording medium is detected based on a detected amount of light reflected from the recording medium. The amount of light reflected when no recording medium is present is first recorded. Then a piece of recording medium can be advanced until all of the irradiating light is reflected from the recording medium and the amount of light reflected from the recording medium is recorded. The amount of light reflected from the recording medium is compared to the amount of light reflected when no recording medium is present. A standard level between these two amounts of light is set by multiplying a constant value C which is greater than 0 and less than 1 by the difference between these measured values and adding that product to the lower value. Constant C is determined based on how far into the detection beam of light the recording medium is to be fed. For example, when the recording medium is more reflective then the guide; at 0, the recording medium will not be fed in to the beam at all. At 1, the recording medium will be fed until all of the beam of light is reflected by the recording medium. A number between 0 and 1 will result in a feed position between these two extremes. In an embodiment of the invention the recording medium is then moved in the reverse "upstream" direction to a position where it is possible to detect the amount of light reflected with no recording medium present. Then the recording medium is again fed in the forward direction, and when the amount of light reflected equals the predetermined standard level it is determined that a leading edge of the recording medium has reached a predetermined standard start position.

Because the distance the recording medium is fed in order to move from a location in which all of the light is reflected from the recording medium guide and not from the recording medium to a location in which all of the light is reflected from the recording medium is constant regardless of the reflective characteristics of the recording medium, the value of the difference between the amount of light reflected from only the recording medium guide and from only the recording medium is constant. Thus, the standard level obtained when this differential value is multiplied by a constant value C is also constant. Therefore, the relative position of the recording medium end portion with respect to the sheet end detector when the amount of reflected light has reached the predetermined standard level is also constant.

Accordingly, it is an object of this invention to provide an improved method and apparatus for detecting an edge of a recording medium.

A further object of the invention is to provide an improved method and apparatus for reducing any error in the positioning an edge of a recording medium prior to and during a printing operation.

Still other objects and advantages of the invention will in part be obvious and will in part be apparent from the specifications and drawings.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken connection with the accompanying drawings, in which:

FIG. 1(*b*) is a top plan view of a carriage of the apparatus of FIG. 1 (*a*);

FIG. 6 is a top plan view of the detection area of a piece of a recording medium;

FIG. 7 is a graphical representation of the change of detector voltage with paper feed amount, showing errors which occur when recording papers with different reflective characteristics are aligned for printing with a conventional apparatus.

DETAILED DESCRIPTION OF THE PREFERRED EMBODIMENTS

Figure 1A:
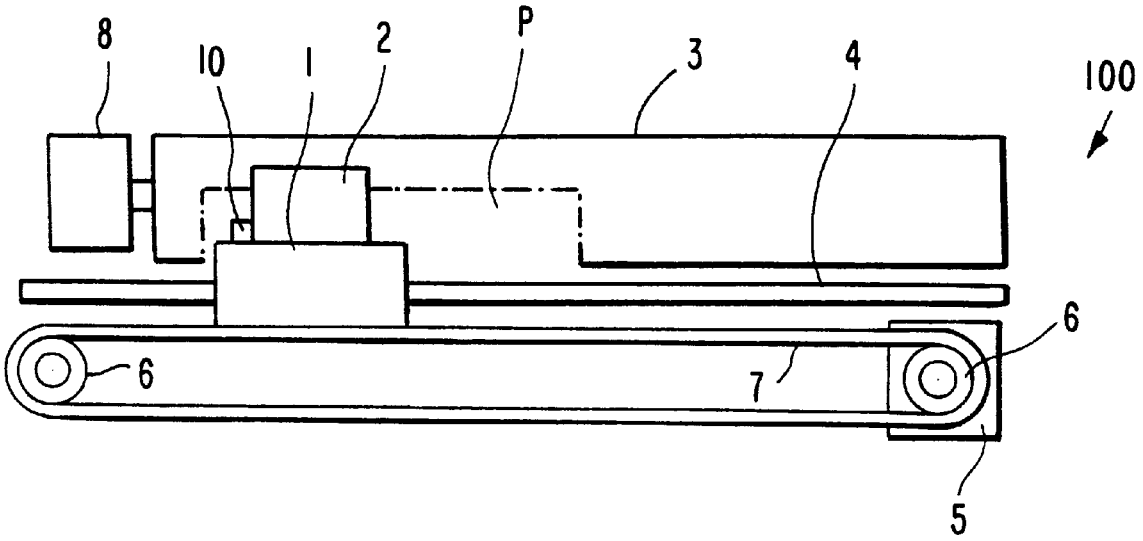
FIG. 1(*a*) a top plan view depicting a serial recording apparatus employing a sheet end detection system constructed in accordance with an embodiment of the invention.
Figure 1B:
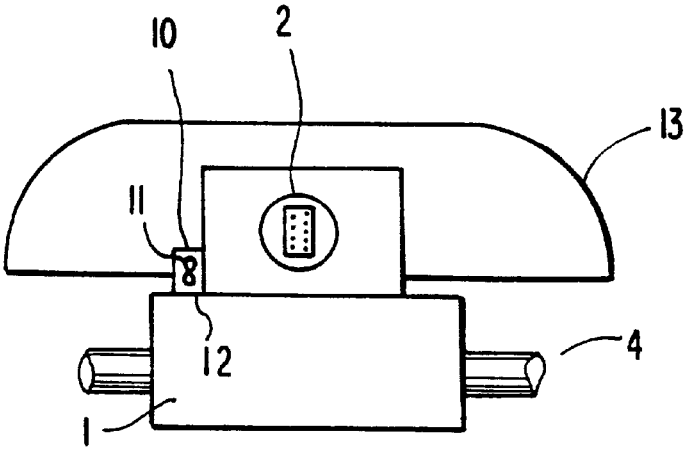

Referring first to FIGS. 1(*a*) and 1(*b*), a first embodiment of the present invention is shown in which a recording apparatus 100 is shown having a carriage 1 on which is mounted a recording head 2 driven by a drive motor 5 via a timing belt 7 which bridges idling rollers 6. (Recording head 2 can be, but is not limited to, an impact wire type recording head, an ink jet type recording head or a thermal transfer type recording head). Recording head 2 moves reciprocally along a guide 4 forming a recording paper guide path parallel to the axis of a paper feed roller 3.

A sheet end detector 10 is positioned a constant predetermined distance from recording head 2 on carriage 1, in the vicinity of recording head 2, as shown more clearly in FIG. 1(*b*). Sheet end detector 10, includes a light-emitting element 11 which projects a beam of light for irradiating paper feed roller 3 or a recording medium when a recording medium is disposed on paper feed roller 3. Sheet end detector 10 also includes a light-receiving element 12 disposed in a position to receive light from light-emitting element 11 that is reflected from paper feed roller 3 or from the piece of recording medium disposed thereon. Conventional light emitting and light receiving elements can be used. Apparatus 100 also includes a paper holder 13 which guides the printing surface of a piece of a recording medium P.

Figure 2:
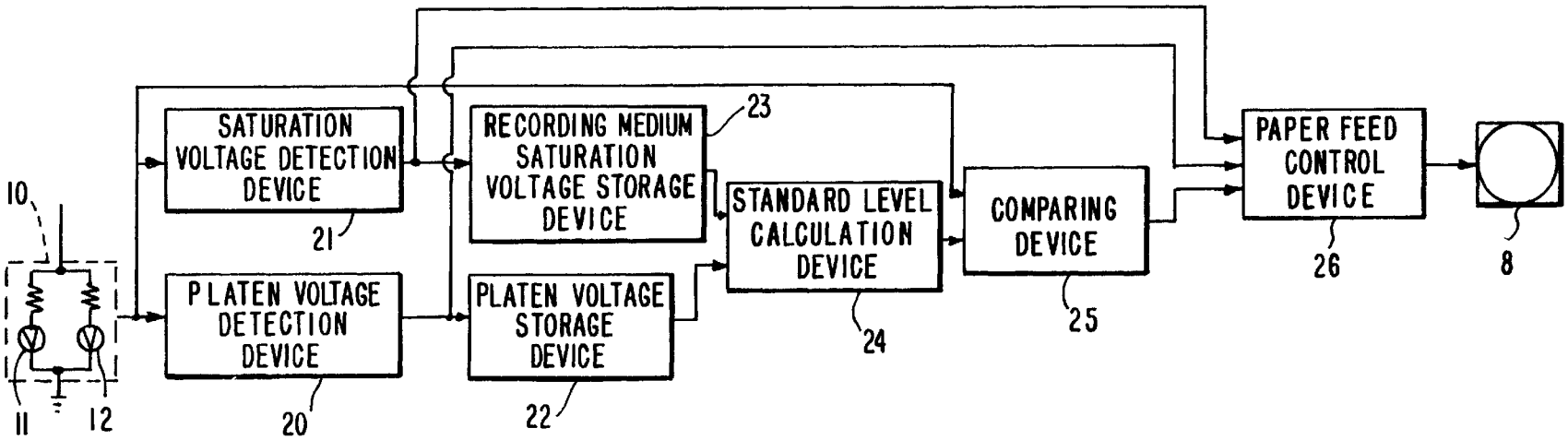
FIG. 2 a block diagram of a sheet end detection apparatus, constructed in accordance with an embodiment of the invention.

Referring next to FIG. 2, sheet end detector 10 is shown in block diagram form. In operation, light is emitted from light-emitting element 11. Before a piece of recording medium is loaded, a platen voltage detection device 20 measures the amount of light reflected when all of the light is reflected from paper feed roller 3, which forms a recording paper guide. A voltage corresponding to the detected light level (hereinafter referred to as platen voltage Vp) is generated from light-receiving element 12 of sheet end detector 10. Voltage Vp therefore corresponds to the amount of light reflected when recording medium P is not present. If the paper guide is more reflective then the recording medium, this voltage is referred to as Vp'.

As recording medium P advances to paper feed roller 3, along the paper path, light reflecting back to light-receiving element 12 will eventually all be reflected by recording medium P. At this point, a recording medium saturation voltage detection device 21 detects the amount of light reflected when all of the light emitted is reflected by recording medium P and a voltage corresponding to this detected light level (hereinafter referred to as paper saturation voltage Vm) is generated from light-receiving element 12. When the recording medium is less reflective than the paper guide, this voltage is referred to as voltage Vm'. Platen voltage Vp and paper saturation voltage Vm are respectively stored in platen voltage storage device 22 and recording medium saturation voltage storage device 23.

After the value of Vp and Vm are stored, a standard level calculating device 24, calculates standard level voltage Vs by the following equation: $Vs=[(Vm-Vp)\times C]+Vp$ using the difference between platen voltage Vp and recording medium saturation voltage Vm stored in platen voltage storage device 22 and recording medium saturation voltage storage device 23. When the paper guide (e.g. the roller) is more reflective than the recording medium, Vs is calculated as $Vs=[(Vp'-Vm')\times C]+Vm'$. C is a predetermined constant having a positive value greater than 0 and less than 1, for example 0.3.

Constant C is determined based on how far into the beam of light from light-emitting element 11 the recording medium is to be fed. At C=0, the paper will not be fed at all. At C=1, the recording medium will be fed until all of the light emitted is reflected from the recording medium and none is reflected from roller 3. A number between 0 and 1 will result in a feed position between these two extremes. Thus, standard level Vs is calculated and is utilized for determining if a leading edge or trailing edge of a piece of a recording medium has reached a specified predetermined position. This selection of C is accurate regardless of the reflective characteristics of the recording medium.

A comparing device 25 outputs a signal when the voltage level from end detector 10 corresponds to the standard predetermined level Vs, thereby detecting and determining that either the leading edge or the trailing edge of a piece of a recording medium has reached a predetermined position. In a preferred embodiment, comparing device 25 outputs a signal after a piece of a recording medium is loaded and is fed to a predetermined position. This signal operates as a forward paper feed halt signal to a paper feed control device 26, described below.

Paper feed control device 26 controls a paper feed motor 8, causing it to operating in the forward or reverse direction in order to feed a piece of a recording medium. Paper feed motor 8 stops feeding the recording medium when a forward paper feed halt signal is received from comparing device 25, and sets the piece of recording medium at a predetermined position in order to commence a print operation.

Figure 3A:
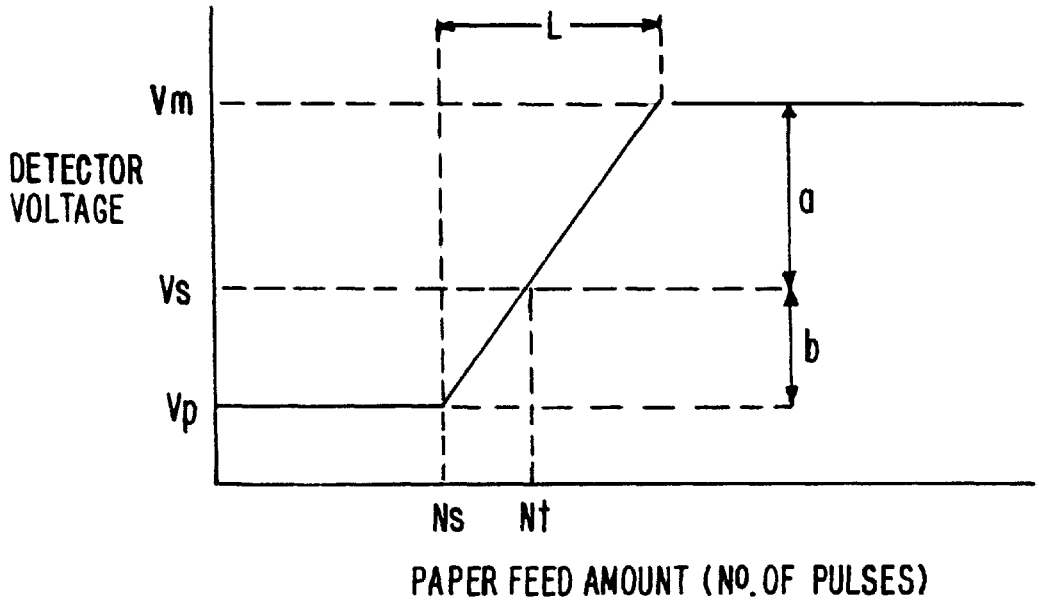
FIG. 3(*a*) and FIG. 3(*b*) are graphical representations of the change of detector voltage with paper feed amount for a recognition operation of a leading or trailing edge of a piece of a recording medium, in accordance with an embodiment of the invention.
Figure 3B:
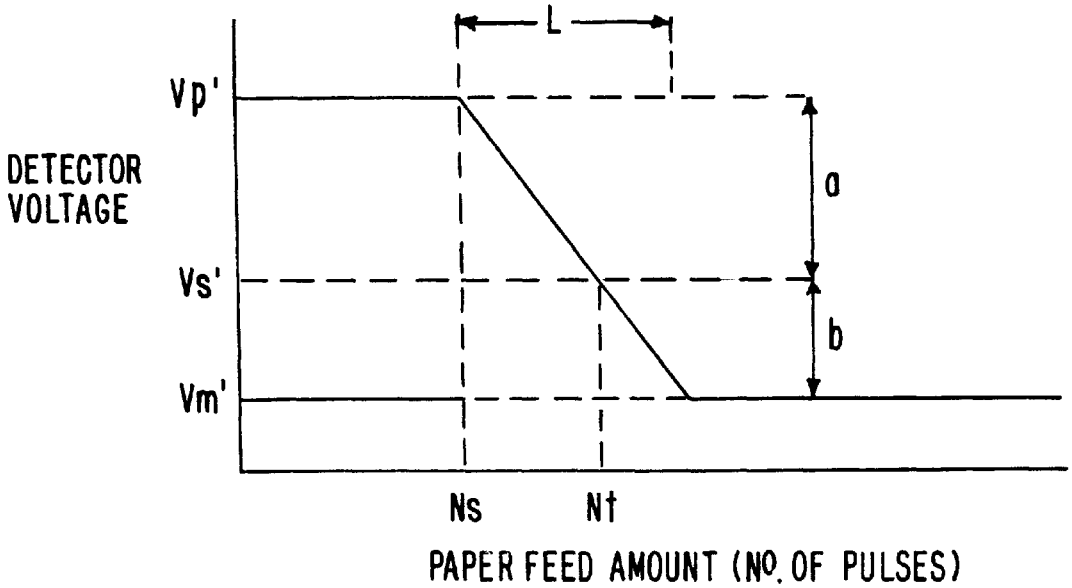
Figure 4:
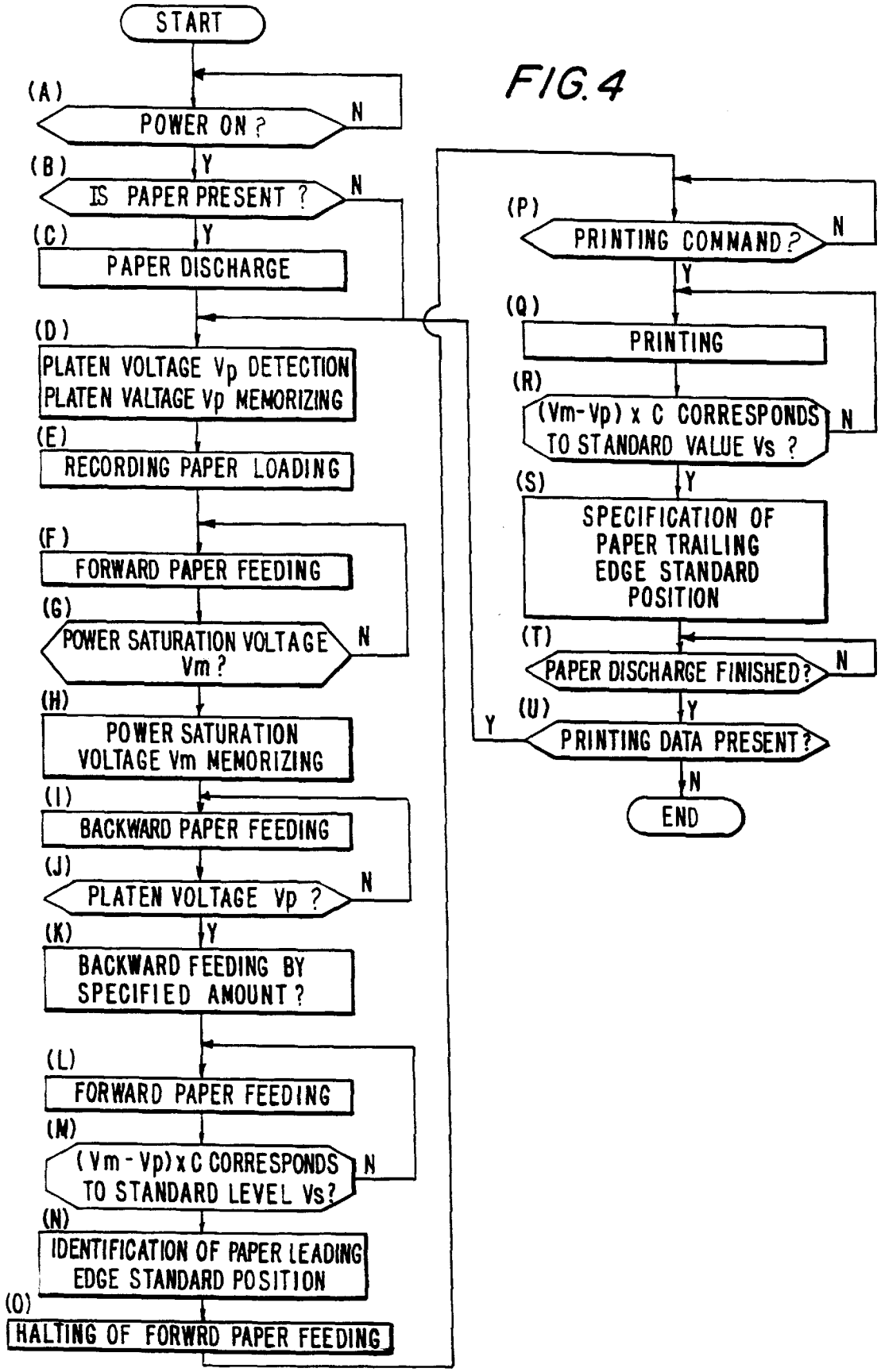
FIG. 4 is a flow chart depicting a method of recognition of a recording medium leading edge and trailing edge,in accordance with an embodiment of the invention.

Next the operation of the apparatus constructed in accordance with the invention is described, making reference to FIGS. 3(*a*), 3(*b*) and 4. FIG. 3(*a*) is a graph depicting the changes in the level of a signal received from a sheet end detector when a recording paper guide is constructed from a material such as rubber which has a light reflectance ratio lower than that of a typical recording medium. FIG. 3(*b*) is a graph depicting the changes in the level of a signal received from a sheet end detector when a recording paper guide is constructed from metal or the like which has a light reflectance ratio higher than that of a recording medium. Paper feeding is carried out by a roller disposed in another location.

When a power source is switched on (Step A), the presence or absence of a piece of a recording medium is detected by a sheet end detector and other paper detectors (Step B), and if a recording medium is present from the previous print operation, paper feed roller 3 is rotated and the recording medium is discharged (Step C).

As light from light-emitting element 11 of sheet end detector 10 irradiates paper feed roller 3 when no recording medium is present, light-receiving element 12 receives light reflected from paper feed roller 3 only. The amount of light reflected from paper feed roller 3 detected by platen voltage detection means 20 is stored in platen voltage storage means 22 as platen voltage Vp or Vp' (Step D). (Vp being the voltage when the guide means is less reflective than the recording medium, and Vp' being the voltage when the guide means is more reflective than the recording medium.)

Next, a piece of a recording medium is loaded (Step E). Paper feed control device 26 causes paper feed motor 8 to rotate in a forward direction and the recording medium is fed in the forward direction (Step F). When the leading edge of the recording medium reaches the vicinity of sheet end detector 10, light from light-emitting element 11 begins to be is reflected from the recording medium, the amount of light detected by light-receiving element 12 changes at a rate of change governed by the reflectance ratio of the recording paper.

Consequently, as shown in FIGS. 3(*a*) and 3(*b*), the voltage of the signal from sheet end detector 10 gradually changes according to the differences in the reflectance ratios of the recording medium guide and the recording medium as the edge of the recording medium advances into the beam of light. For example, when the reflectance ratio of the recording medium guide is lower than that of the recording medium the voltage gradually increases. When the reflectance ratio of the recording medium guide is higher, the voltage will gradually decrease. When the recording medium is moved to a position where all of the light from light-emitting element 11 is reflected by the recording medium, the signal from sheet end detector 10 reaches the level corresponding to an amount of light governed by the reflectance ratio of the recording paper, which is the saturation amount of light Vm.

In this case, all the light received by light-receiving element 12 has been reflected from the recording medium, and regardless of how much of the recording medium has been fed, the signal from sheet end detector 10 reaches a voltage determined according to the reflectance ratio of the recording medium; that is, paper saturation voltage Vm or Vm'(Step G) (Vm being the voltage when the guide is less reflective than the recording medium Vm' being the voltage when the guide is more reflective than the recording medium), and this voltage is a constant value. Paper saturation voltage detector 21 detects this paper saturation voltage Vm or Vm' and stores it in paper saturation voltage memorizing device 23 (Step H).

After paper saturation voltage Vm or Vm' is detected and memorized, paper feed control device 26 rotates paper feed motor 8 in the reverse direction, which feeds the recording medium in the reverse direction (Step I). The leading edge of the recording medium is stopped outside the detection region of sheet end detector 10. This position is detected when the recording medium is outside the detection region, whereby light from light-emitting element 11 of sheet end detector 10 irradiates and is reflected by paper feed roller 3 only. Thus, when the platen voltage Vp is detected again by platen voltage detection device 50 (Step J) the recording medium is stopped from being fed in the reverse direction (Step K).

Next, paper feed control device 26 causes paper feed motor 8 to rotate in the forward direction and feeds the recording medium in the forward direction towards recording head 2 (Step L). As the leading edge of the recording medium enters the detection region of sheet end detector 10, the amount of light emitted from light-emitting element 11 of sheet end detector 10 and received by light-receiving element 12 corresponds to the combined reflectance ratios of the recording medium guide and the recording medium, and changes in proportion to the amount of the recording medium that has been fed.

Comparing device 25 compares the signal from sheet end detector 10 and the relevant recording paper determination standard Vs and Vs' calculated by standard level calculation device 24 (Step M) (Vs being the voltage when the guide is less reflective than the recording medium, and Vs' being the voltage when the guide is more reflective than the recording medium.) When the amount of reflected light equals the computed standard value Vs or Vs', it is determined that the leading edge of the recording medium Ns has reached a standard predetermined position Nt (Step N). Paper feed control device 26 halts the paper feed operation and positions the leading edge of the recording medium Ns at predetermined position Nt (Step 0).

Figure 5A:
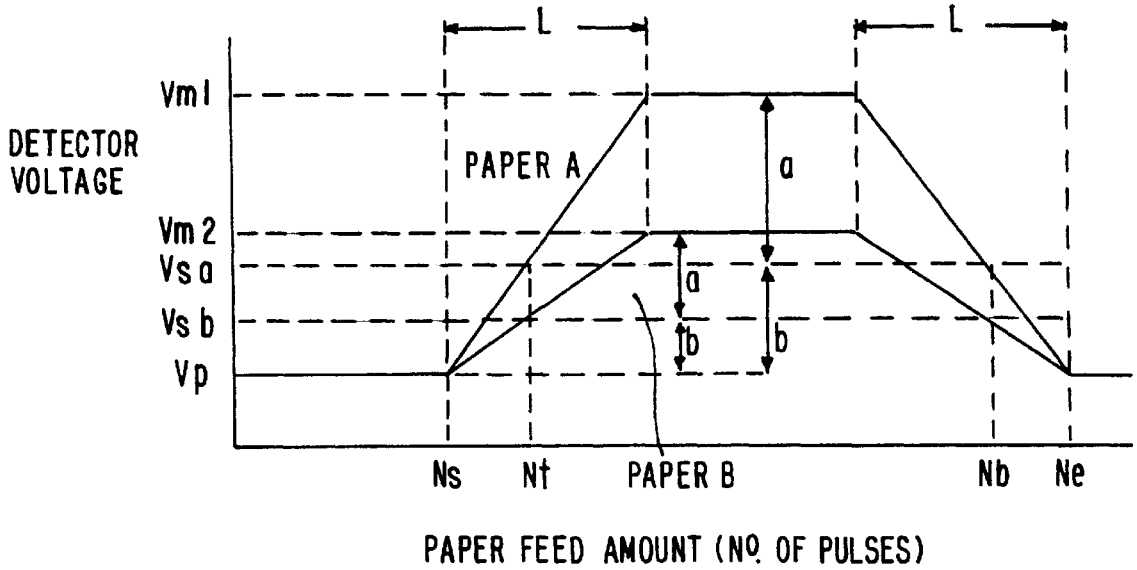
FIG. 5(*a*) and FIG. 5(*b*) are graphical representations of the change of detector voltage with paper feed amount for the recognition operation of the leading and trailing edges of pieces of recording medium when the amount of light reflected from each piece of recording medium is different, in accordance with an embodiment of the invention.
Figure 5B:
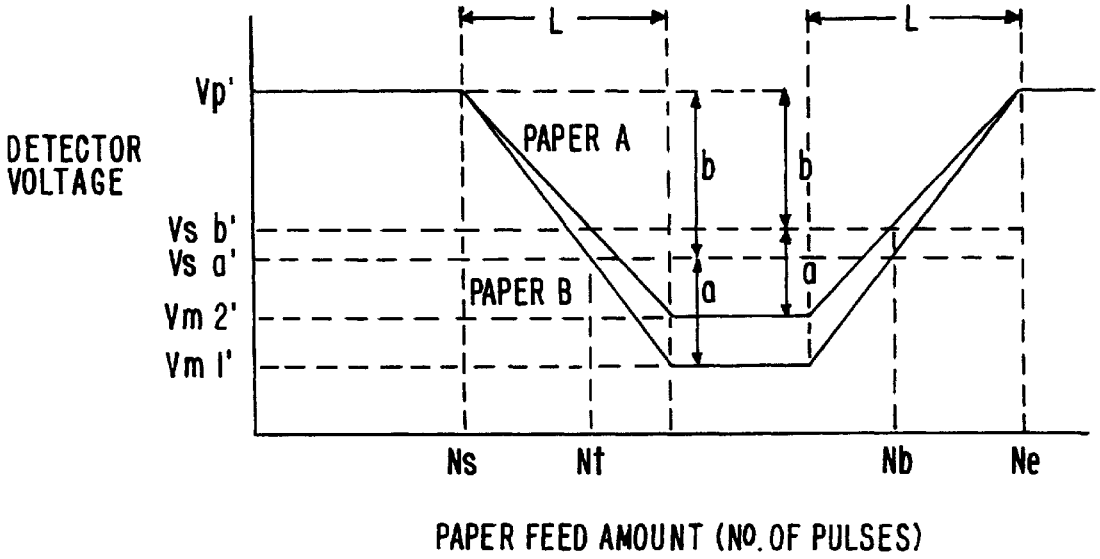

Referring next to FIGS. 5(*a*) and 5(*b*), the values of the amount of reflected light where the light from light-emitting element 11 of sheet end detector 10 is reflected only from the recording medium saturation voltage Vm1, Vm2, Vm1', and Vm2', (Vm1 and Vm2 being voltages for two recording mediums having different reflectance characteristics when the recording medium guide is less reflective than either of the recording mediums, Vm1' and Vm2' being voltages for two recording mediums having different reflective characteristics when the recording medium guide is more reflective than either of the recording mediums) is influenced by the reflectance ratios due to the characteristics of two different recording mediums, paper A and paper B. However, the amount of light reflected when the light from light-emitting element 11 of sheet end detector 10 is reflected only from paper feeder roller 3 insures that platen voltage Vp (or Vp') is fixed at a characteristic value dependent upon the reflectance ratio of recording medium feed roller 3. Therefore, each difference in voltages generated by the recording medium and roller 3: (Vm1−Vp) and (Vm2−Vp), or (Vp'−Vm1') and (Vp'−Vm2') is determined principally by the reflectance ratio of each recording medium to be printed upon. Thus, the amount of the recording medium that must be fed for the amount of light reflected only from roller 3 to change to the differences (Vm1−Vp) and (Vm2−Vp), or (Vp'−Vm1') and (Vp'−Vm2') is principally determined by the optical coefficients of light-emitting element 11 and light-receiving element 12 of sheet end detector 10. These are affected by the diameter of the light-emitting element beam and the area of possible reception of the light-receiving element. Therefore, each recording medium will be fed the same amount, regardless of the reflective characteristics of the recording medium.

Consequently, when signals corresponding to standard predetermined values Vsa=[(Vm1−Vp)×C]+Vp, Vsb=[(Vm2−Vp)×C]+Vp, or Vsa'=[(Vp'−Vm1')×C]+Vm1', Vsb'=[(Vp'−Vm2')×C]+Vm2' (obtained from multiplying these differences (Vm1−Vp) and (Vm2−Vp), or (Vp'−Vm1') and (Vp'−Vm2') by a constant ratio and adding back the lower value of the range) are output from sheet end detector 10, the position Nt of the leading edge of the recording medium with respect to sheet end detector 10 is always the same regardless of the characteristics of the recording paper. The distance to feed the recording medium is controlled by constant C, which determines the level of the standard voltage Vs.

A print command is then input (Step P) and printing is commenced (Step Q). Printing continues up to the vicinity of the trailing edge of the recording medium, and as the recording medium begins to move away from sheet end detector 10, the amount of light received by sheet end detector 10 is governed by the paper feed roller 3 and the recording medium reflectance ratio. As the end of the recording medium moves from the detection area, the signal from sheet end detector 10 gradually changes.

Comparing device 25 compares the signal from sheet end detector 10 and the standard level [(Vm1−Vp)×C]+Vp or [(Vp'−Vm1')×C]+Vm1' (Step R). When they are equal, it is determined that the trailing edge Ne of the recording medium has reached a standard predetermined position Nb (Step S). When one page of printing is completed, discharging of the recording medium is carried out (Step T). If printing data still remains, the process moves to Step (D) again, (Step U), and the previously described processes are repeated to print printing data on an additional piece of recording medium.

The standard levels [(Vm1−Vp)×C]+Vp and [(Vp'−Vm1')×C]+Vm1' are set at the time of commencement of printing, based on the reflectance ratio of the recording medium in question. Constant C is set to select a predetermined position. When printing has been completed, the recording medium has the same characteristics of reflectance at the time of sheet end detection as it did when the leading edge was detected. Consequently when the signal from sheet end detector 10 equals the standard level value determined above, the trailing edge Ne of the recording medium in question is determined to have reached a predetermined position Nb with respect to leading edge detector 10 without having to recalculate these standard levels.

As shown in FIGS. 5(*a*) and 5(*b*), the values of the reflected light, when light is reflected only from the recording medium (saturation voltage Vm1 and Vm2, or Vm1' and Vm2') are influenced by the reflectance ratios due to the characteristics of the recording media A and B (paper roughness etc.). However, the values of the detected reflected light when light is reflected only from roller 3 (platen voltage Vp and Vp') are fixed at characteristic values determined by the reflectance ratio of the roller 3. Therefore, each difference determined between the reflected light from the recording medium and paper feed roller 3: (Vm1−Vp) and (Vm2−Vp), or (Vp'−Vm1') and (Vp'−Vm2') is dependent principally upon the reflectance ratio of each piece of recording medium to be printed upon.

The amount the recording medium must be fed for the amount of light reflected only from the recording paper to change to the amount of the differences [(Vm1−Vp) ×C]+Vp and [(Vm2−Vp)×C]+Vp, or [(Vp'−Vm1')×C]+Vm1' and [(Vp'−Vm2') ×C]+Vm2' is determined principally by the optical coefficients of light-emitting element 11 and light-receiving element 12 of sheet end detector 10, that is, the diameter of the light-emitting element beam and the area of possible reception of the light-receiving element Therefore, each recording medium will be fed the same amount, regardless of the reflective characteristics of the recording medium.

Consequently, when signals corresponding to standard predetermined values Vsa=[(Vm1−Vp)×C]+Vp, Vsb=[(Vm2−Vp)×C]+Vp, or Vsa'=[(Vp'−Vm1')×C]+Vm1', Vsb'=[(Vp'−Vm2')×C]+Vm2', obtained from multiplying these differences (Vm1−Vp) and Vm2−Vp), or (Vp'−Vm1') and (Vp'−Vm2') by a constant ratio and adding back the lower value of the two voltage values, are output from sheet end detector 10, the position Nb of the trailing edge Ne of the recording paper with respect to sheet end detector 10 is always the same regardless of the nature of the recording paper.

There may be variations in strength of light emission and area of irradiation in light-emitting elements 11, and sensitivity and range of possible reception of light-receiving elements 12 in a plurality of recording apparatus. However, these features are peculiar to each sheet end detector 11. They are unrelated to the type of recording paper. Therefore, the detection of a leading and trailing edge can be determined with great accuracy when the invention is employed. The position where a leading edge or trailing edge is identified is constant, irrespective of the nature of the paper. Therefore, variations among recording apparatus in the position where a leading edge or trailing edge is identified can be easily corrected by adjusting the position of the sheet end detector 11 or the choice of constant C accordingly, and as a result it is possible to detect the leading edge and trailing edge with a constant level of accuracy.

While the method and apparatus described above are employed in a serial type printing apparatus, it is equally applicable to a page recording apparatus transferring a toner image formed on a photoconductive drum to a recording medium. Additionally, while the leading edge and trailing edge of a recording medium are detected by the same detector, a second sheet end detector having the same construction for detecting a trailing edge maybe disposed in a position suitable for detecting the trailing edge. If there is no influence due to changes in the nature of the paper, the amount of light detected by this second sheet end detector may be compared to the standard predetermined reflected light level determined when printing first commences, and the trailing edge of the recording medium can be detected.

As explained above, the invention comprises a process for determining the amount of light reflected from a recording paper guide. The steps include determining the amount of light reflected from the recording medium and calculating the difference between that amount of light reflected and the amount of light reflected from the recording media guide. A standard level is determined by multiplying a value C which should be greater than 0 and less than 1 by the difference between the detected light reflected from the recording medium and from the guide. Value C is an indication of the desired position of the leading edge of the recording medium with respect to the beam of light. In one embodiment of the invention, the recording medium is fed back towards an upstream direction to a position where it is possible to detect that the light is reflected only by the recording paper guide. The recording medium is then advanced, until it is determined that the leading edge of the recording medium has reached a standard predetermined position, when the amount of light reflected equals the standard level. The leading edge or trailing edge of a piece of recording medium can thus be identified with a high level of accuracy regardless of the nature of the recording medium and the detection region and sensitivity of the sheet end detector. Thus, the standard for components making up the sheet end detector can be relaxed, and the cost can be reduced.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for detecting an end portion of a piece of a recording medium in a recording apparatus defining a forward direction and having a recording medium guide for positioning the recording medium, in which a recording medium is irradiated with light directed to a sensing location from a light source and the position of the end portion is detected based on the amount of light reflected from said recording medium as it travels through the sensing location, comprising the steps of:

determining and storing the amount of light reflected from a recording medium guide of a recording apparatus, the recording apparatus defining a forward direction;

feeding a piece of a recording medium in the forward direction through the recording apparatus, to a sensing location;

irradiating the recording medium from a light source as it passes the sensing location and determining the amount of light reflected from said recording medium with a reflection detector;

calculating a standard level by calculating the difference between the amount of light reflected from said recording medium only (M) and the amount of light reflected from said recording medium guide only (G) and multiplying said difference by a constant C which is greater than 0 and less than 1 and then adding said product to the lesser of M and G;

moving the paper through the sensing location and determining when the amount of light detected by the reflection detector equals said standard level.

2. The method of claim 1, including the steps of:

feeding said recording medium in the forward direction; and then determining when a leading edge of the recording medium passes through the sensing location and the amount of light detected by the reflection detector equals said standard level.

3. The method of claim 1, including the steps of:

feeding said recording medium in the forward direction; and then determining when a trailing edge of the recording medium passes through the sensing location and the amount of light detected by the reflection detector equals said standard level.

4. The method of claim 1, including the step of:

selecting said constant C so that a standard level can be set between the reflectance ratio of said recording medium guide and a reflectance ratio of said recording medium.

5. The method of claim 1, wherein said constant C is related to the distance said piece of recording medium is to be fed before said standard level is reached.

6. The method of claim 1, wherein the paper is fed in the forward direction to the sensing location prior to determining the amount of light reflected from the recording medium only, then fed in the reverse direction until it is out of the sensing location, then re-fed in the forward direction.

7. A recording medium end portion detection apparatus, comprising:

a recording medium guide constructed to guide and support a recording medium passing through the guide in a printing direction;

a light source emitting light toward the guide constructed to measure light emitted from the light source and reflected from at least a recording medium on the guide and the guide itself, and for generating a first voltage signal when said reflected light is reflected only from said recording medium guide, a second voltage signal when said reflected light is reflected only from said recording medium and an intermediate voltage signal when light is reflected from both the recording medium guide and the recording medium, said first, second and intermediate voltage signals corresponding to the amount of reflected light measured;

a standard value calculator receiving said first, second and intermediate voltage signals and for detecting a difference between said first and second voltage signals to calculate a standard value voltage by multiplying said difference by a constant coefficient C and then by adding the lesser of said first and second voltage signals thereto, C being a numerical value greater than 0 and less than 1;

a comparator responsive to a signal from the standard value calculator constructed to compare said standard value voltage and said intermediate voltage signal and determining when said intermediate voltage signal corresponds to said standard value voltage and generating an edge present signal in response thereto.

8. The end portion detection apparatus of claim 7, wherein said constant C is related to the distance said piece of recording medium is to be fed before said standard value is reached.

9. The end portion detection apparatus of claim 7, wherein:

said constant coefficient C is selected so that a standard level can be set between the reflectance ratio of said recording medium guide and a reflectance ratio of a recording medium closest to the reflectance ratio of said recording medium guide.

10. The end portion detection apparatus of claim 7, wherein:

said paper feed controller stops a paper feed operation in response to said edge present signal.

11. The end portion detection apparatus of claim 7, including:

a light-emitting element; and a light-receiving element, said light-emitting element reflecting light off a reflection location to the light-detecting element.

12. The end portion detection apparatus of claim 11, wherein said light-emitting element and said light-receiving element are optically opposed by said recording medium guide.

13. The end portion detection apparatus of claim 7 wherein said recording medium guide is a roller.

14. The end portion detection apparatus of claim 7 wherein said recording medium is a piece of paper.

15. The end portion detection apparatus of claim 7 wherein said controller includes a motor.

16. The end portion detection apparatus of claim 7 including a paper feed controller, said paper feed controller being responsive to the edge present signal and for feeding a piece of a recording medium in the forward direction before commencing printing thereon.

17. The end portion detection apparatus of claim 7 wherein said first, second and intermediate voltage signals are proportional to the amount of reflected light measured.

18. A method for detecting an end portion of a piece of a recording medium in a recording apparatus, comprising the steps of:

determining the amount of light reflected from a recording medium guide of a recording apparatus;

determining the amount of light reflected from a recording medium;

calculating a standard level by calculating the difference between the amount of light reflected from said recording medium and the amount of light reflected from said recording medium guide, multiplying said difference by a constant C which is greater than 0 and less than 1 and adding this product to the lesser of the amount of light reflected from the recording medium guide or from the recording medium;

positioning said recording medium to a where an amount of light detected equals said standard level.

19. The method of claim 18, further comprising the step of generating voltage signals corresponding to each of the amount of light reflected from the recording medium guide and from the recording medium.

* * * * *